US006516627B2

(12) United States Patent
Ring et al.

(10) Patent No.: US 6,516,627 B2
(45) Date of Patent: Feb. 11, 2003

(54) FLOWING POOL SHELL AND TUBE EVAPORATOR

(75) Inventors: H. Kenneth Ring, Houston, MN (US); Jon P. Hartfield, La Crosse, WI (US); Sean A. Smith, La Crosse, WI (US); William J. Peck, Pueblo, CO (US)

(73) Assignee: American Standard International Inc., New York, NY (US)

( * ) Notice: Subject to any disclaimer, the term of this patent is extended or adjusted under 35 U.S.C. 154(b) by 76 days.

(21) Appl. No.: 09/849,557

(22) Filed: May 4, 2001

(65) Prior Publication Data

US 2002/0162352 A1 Nov. 7, 2002

(51) Int. Cl.[7] ..... F25B 43/02

(52) U.S. Cl. ..... 62/471; 62/470; 62/515; 62/473; 62/506; 62/193; 62/469

(58) Field of Search ..... 62/470, 515, 473, 62/506, 468, 193, 469, 471

(56) References Cited

U.S. PATENT DOCUMENTS

| | | | | |
|---|---|---|---|---|
| 2,535,996 A | | 12/1950 | Worn et al. | |
| 3,789,617 A | | 2/1974 | Rannow | |
| 5,419,155 A | * | 5/1995 | Boehde et al. | 62/470 |
| 5,645,124 A | | 7/1997 | Hartfield et al. | |
| 5,761,914 A | | 6/1998 | Carey et al. | |
| 6,167,713 B1 | | 1/2001 | Hartfield et al. | |
| 6,170,286 B1 | * | 1/2001 | Keuper | 62/471 |
| 6,233,967 B1 | * | 5/2001 | Seewald et al. | 62/470 |
| 6,293,112 B1 | * | 9/2001 | Moeykens et al. | 62/84 |
| 6,341,492 B1 | * | 1/2002 | Carey | 62/84 |
| 6,357,239 B2 | * | 3/2002 | Carey | 62/84 |

FOREIGN PATENT DOCUMENTS

| | | |
|---|---|---|
| GB | 622 043 | 4/1949 |
| GB | 2 161 256 A | 7/1986 |
| WO | WO 01/90664 A1 | 11/2001 |

* cited by examiner

*Primary Examiner*—William C. Doerrler
*Assistant Examiner*—Mark Shulman
(74) *Attorney, Agent, or Firm*—William J. Beres; William O'Driscoll

(57) ABSTRACT

An evaporator for a refrigeration chiller includes a tube bundle in which at least a portion of the tubes of the tube bundle are immersed in a pool which include both liquid refrigerant and is lubricant. Liquid refrigerant and lubricant are deposited into the pool at a first pool location. Because of the vaporization of refrigerant that occurs within the pool, a pattern of flow is established and managed that causes the lubricant in the pool to migrate from the location of its deposit into the pool to a second pool location. An outlet is provided at the second pool location from which lubricant is drawn out of the evaporator.

58 Claims, 4 Drawing Sheets

FLOWING POOL SHELL AND TUBE EVAPORATOR

BACKGROUND OF THE INVENTION

The present invention relates to evaporators used in refrigeration chillers. More particularly, the present invention relates to an evaporator in which a pattern of flow in the liquid pool found in the evaporator shell is established and managed so as to accomplish and enhance lubricant return from that pool to a chiller system compressor.

Refrigeration chillers are machines which produce chilled water, most often for use in building comfort conditioning or industrial process applications. Such chillers typically employ a compressor to compress a refrigerant gas from a lower to a higher pressure. The higher pressure gas discharged from such a compressor is delivered to the chiller's condenser where it is cooled and condenses to liquid form.

The refrigerant is then delivered from the condenser to and through an expansion device, which lowers the pressure of the refrigerant and still further cools it by the process of expansion. From the expansion device, the refrigerant is delivered to the system evaporator where it absorbs heat which is carried into the evaporator from the heat load which it is the purpose of the chiller to cool. As a result of the heat exchange process that occurs within the evaporator, the refrigerant vaporizes and is drawn back to the compressor where the process begins anew.

Because of the nature of compressors used in refrigeration chillers, a portion of the lubricant used within such compressors, which most often will be oil, makes its way into the stream of refrigerant gas that is discharged from the compressor. At least some of such lubricant is carried into the system condenser entrained in the stream of refrigerant gas that is discharged from the compressor. While various oil separators and oil separation schemes can be and are employed to remove the majority of the lubricant from the gas stream discharged from a compressor, at least a relatively small portion of such lubricant does make its way into the system condenser.

As hot refrigerant gas delivered into a chiller condenser condenses, it falls to the bottom thereof together with any lubricant that has been carried into the condenser or, in the case of an air-cooled condenser, the vapor is swept out of the condenser as a result of refrigerant flow. The condensed refrigerant and oil then flow, as noted above, from the condenser through an expansion device and into the chiller's evaporator. If the lubricant that is carried into the chiller's evaporator is not returned to the compressor from the evaporator on a continuous basis, it will accumulate in the evaporator and the compressor will eventually become starved for oil. Further, as lubricant concentration builds within an evaporator, the thermal performance of the evaporator comes to be more and more adversely affected.

Recently, both evaporator and chiller system design have undergone significant change, primarily in an effort to enhance overall chiller efficiency, but also to reduce the amount of refrigerant that is required to be used in chillers of a given capacity. Such changes are found in many aspects of chiller design. Two of the more prominent ones of such changes relate to the kind and nature of both the compressor and evaporator used in chiller systems, particularly in chillers generally in the 70–500 refrigeration ton capacity range.

In that regard, so-called flooded evaporators have historically been used in chiller systems in the 70–500 refrigeration ton capacity range as have been large capacity reciprocating or small capacity centrifugal chillers. In the late 1980's and early 1990's compressors of the screw type came to be developed and employed in chillers within that capacity range. While superior in many respects to large reciprocating and small centrifugal compressors in chillers within that capacity range, screw compressors, by their nature, cause a relatively large amount of oil to be entrained the stream of gas that is discharged from them. As a result, oil separation, management and return in chiller systems employing screw compressors is a more complex and critical undertaking.

In the mid-1990's, evaporator technology evolved and resulted in the employment of so-called falling film technology in certain chillers generally in the 70–500 ton capacity range. The move to falling film evaporator designs was driven, in part, by the increasing expense of refrigerants used in refrigeration chillers. Falling film evaporators, by their nature, reduce the amount of refrigerant employed in chillers as compared to chillers of similar capacity which employ flooded evaporators.

In that regard, flooded evaporators require the use of larger refrigerant charges because the evaporator shell must contain enough liquid refrigerant to immerse the large majority or all of the tubes of the evaporator tube bundle. In falling film evaporators, on the other hand, liquid refrigerant is distributed and deposited in smaller amounts onto the tube bundle from above and generally across the length and width thereof. Such liquid refrigerant trickles downward through the bundle in the form of a film and only a relatively small percentage of the tubes of the tube bundle are immersed in a liquid refrigerant pool at the bottom of the evaporator shell. The result, once again, is to significantly reduce the size of the chiller's refrigerant charge. In the case of both flooded and falling film evaporators, however, lubricant does make its way into the interior of the evaporator shell and into the liquid pool found therein.

Even though falling film evaporators have proven to be highly efficient and reduce the size of refrigerant charges used in chiller systems, their employment does bring with it associated costs and complexities that can offset the savings gained by reducing the size of a chiller's refrigerant charge. This is particularly true in the lower portion of the 70–500 ton capacity range. Such complexities relate, among other things, to the process and apparatus by which oil is returned from a falling film evaporator to the system compressor and to the need, for the sake of efficiency, to achieve uniform distribution of liquid refrigerant across the length and width of tube bundles in such evaporators.

Because of certain of the complexities and the relative expense associated with the employment of falling film evaporators in refrigeration chiller systems, particularly those generally at the lower end of the 70–500 ton capacity range, and despite the advantages of the use thereof in terms of overall system efficiency and reduced refrigerant charge, the need continues to exist for still further advanced and/or differentiated evaporator designs which are of comparable or increased benefit and efficiency yet which are relatively less complex and/or expensive to employ.

SUMMARY OF THE INVENTION

It is an object of the present invention to provide an evaporator for a refrigeration chiller system that is economical of manufacture, efficient with respect to its thermal performance and the design and operation of which enhances the process of oil return to the system compressor.

It is a further object of the present invention to proactively establish a flow pattern in the pool of liquid refrigerant and oil that is found in refrigeration chiller evaporator and to proactively manage that flow so as to concentrate oil within that pool at a predictable location.

It is another object of the present invention to provide a chiller evaporator which by its operation delivers lubricant to a predictable location therewithin and in which thermal efficiency is enhanced by maintaining relatively very low oil concentrations at and around the large majority of the immersed tube surface within the evaporator shell.

It is still another object of the present invention to achieve high thermal performance and excellent lubricant management in the evaporator of a refrigeration chiller by managing liquid refrigerant flow within the evaporator shell so that a pattern of oil movement within the liquid pool at the bottom of the shell is established which delivers oil to a location from where it can easily be removed.

It is another object of the present invention to provide an evaporator for chiller systems of small to medium capacity which, by the application of certain features and concepts generally associated with falling film evaporators to what would otherwise be categorized as flooded evaporators, are made more cost effective overall than falling film evaporators, are generally equal thereto in terms of thermal performance and in which oil concentration is predictably managed to facilitate the return of such oil to the chiller's compressor.

It is a further object of the present invention to provide an evaporator for chiller systems of medium to relatively larger capacity which, by the employment of managed flow in the liquid pool at the bottom of the evaporator shell and features primarily associated with falling film evaporators, together with apparatus for displacing liquid refrigerant generally to one end of the evaporator shell prior to its entry into the liquid pool, achieves effective lubricant management and return while maintaining and/or exceeding the thermal efficiency of current falling film evaporators.

These and other objects of the present invention, which will be apparent when the following Description of the Preferred Embodiment and attached Drawing Figures are considered, are achieved in a refrigeration system in which refrigerant is delivered into an evaporator shell above both the tube bundle and the liquid pool found therein and in which such refrigerant and any lubricant carried therein is deposited generally onto one end of the liquid pool from where its flow is managed so that lubricant concentrates in a predictable pool location. In that regard, vaporization of liquid refrigerant within that pool sets the pool in motion in a direction away from the location where liquid refrigerant and the lubricant carried therewith is deposited onto the pool surface. Because the liquid pool in the evaporator shell is placed in constant, managed motion in a direction from one end of the shell to the other, lubricant in that pool is caused to continuously flow to one predictable location within the pool in a manner which maintains oil concentration the majority of the liquid pool relatively very low. By maintaining lubricant concentration throughout the majority of the length of the liquid pool relatively very low and by causing lubricant to concentrate in a predetermined pool location from which it can relatively easily be removed, the thermal performance of the evaporator is maintained at a high level while oil return from the evaporator to the system compressor is both simplified and enhanced.

DESCRIPTION OF THE DRAWING FIGURES

Figure 3:
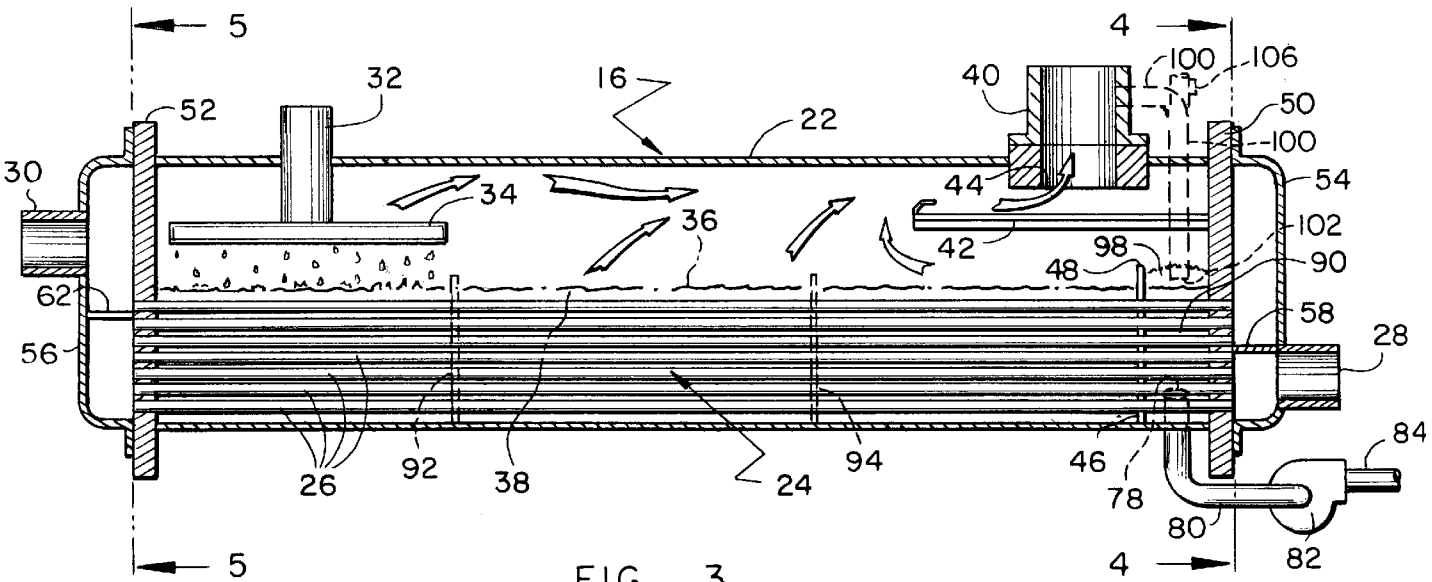
Figure 4:
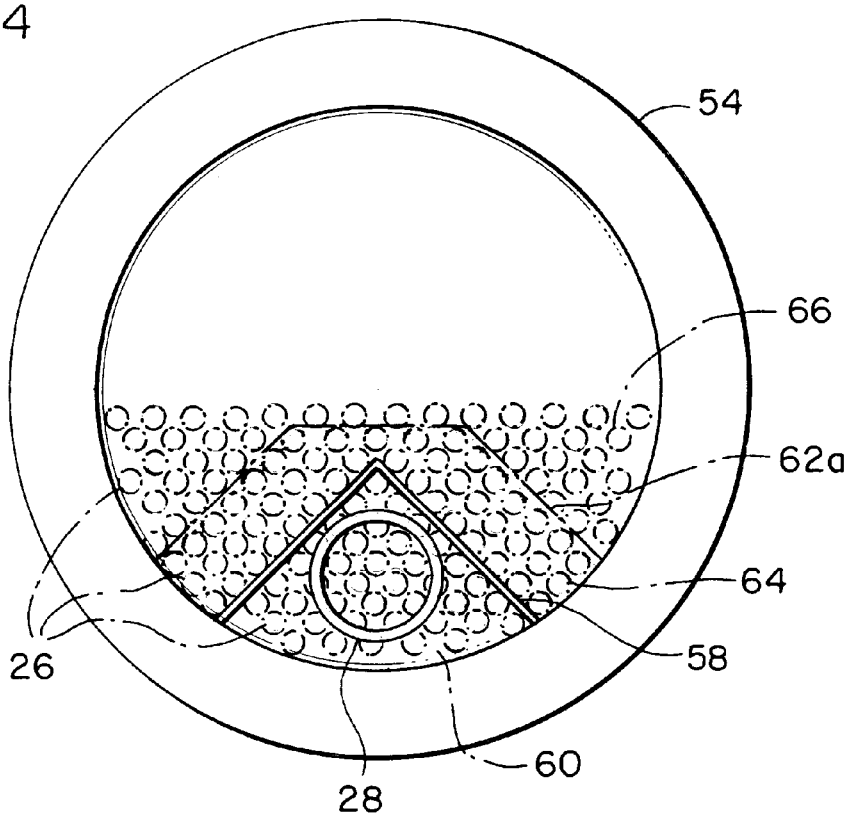
Figure 5:
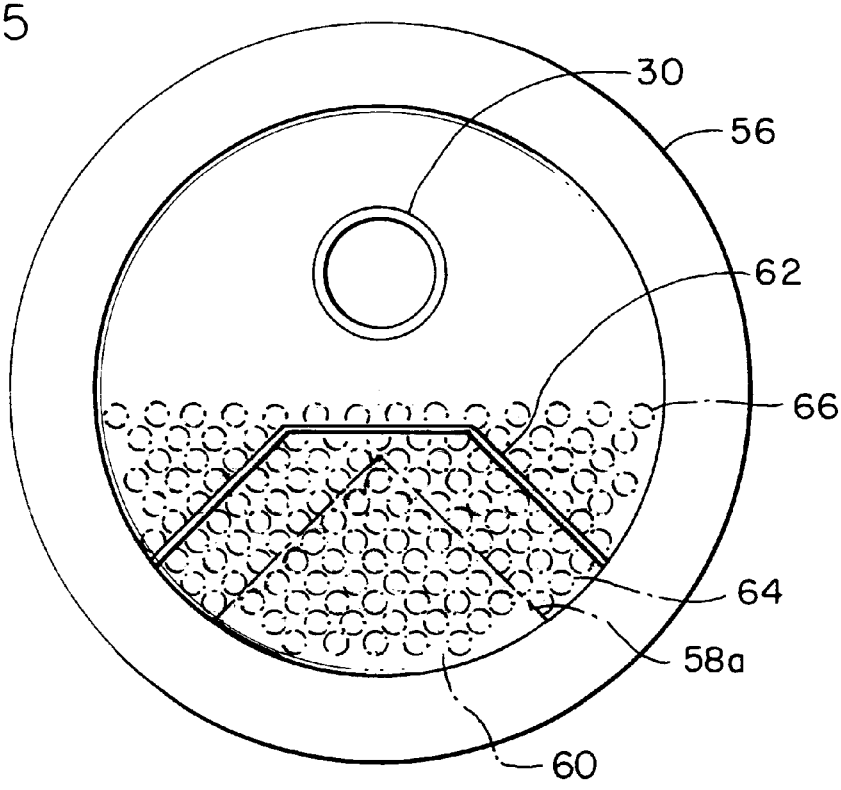

FIGS. 4 and 5 are views of the waterboxes of the present invention taken along lines 4—4 and 5—5 of FIG. 3.

Figure 6:
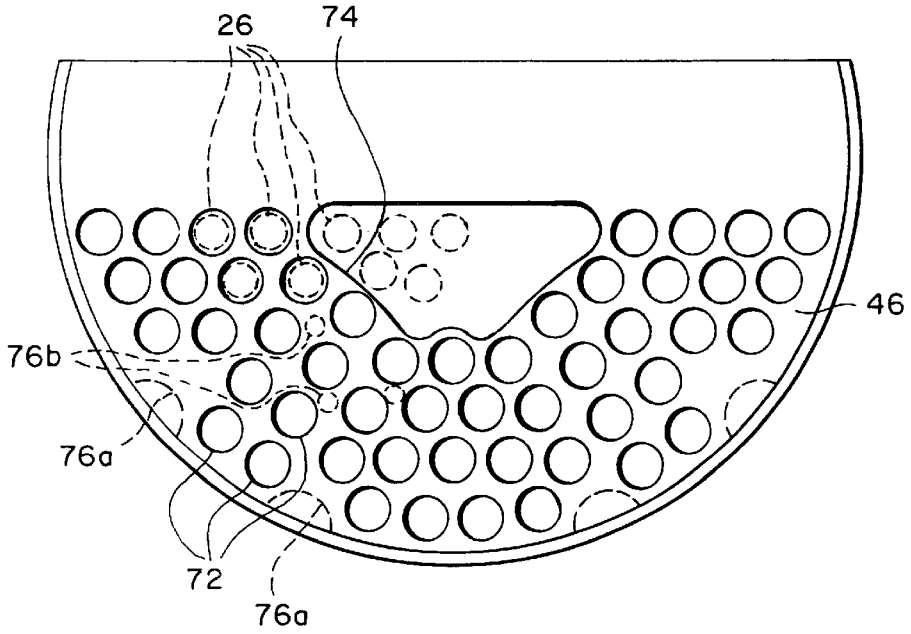

FIG. 6 is a front view of the oil-blockoff baffle preferably used in at least one embodiment of the present invention.

Figure 7:
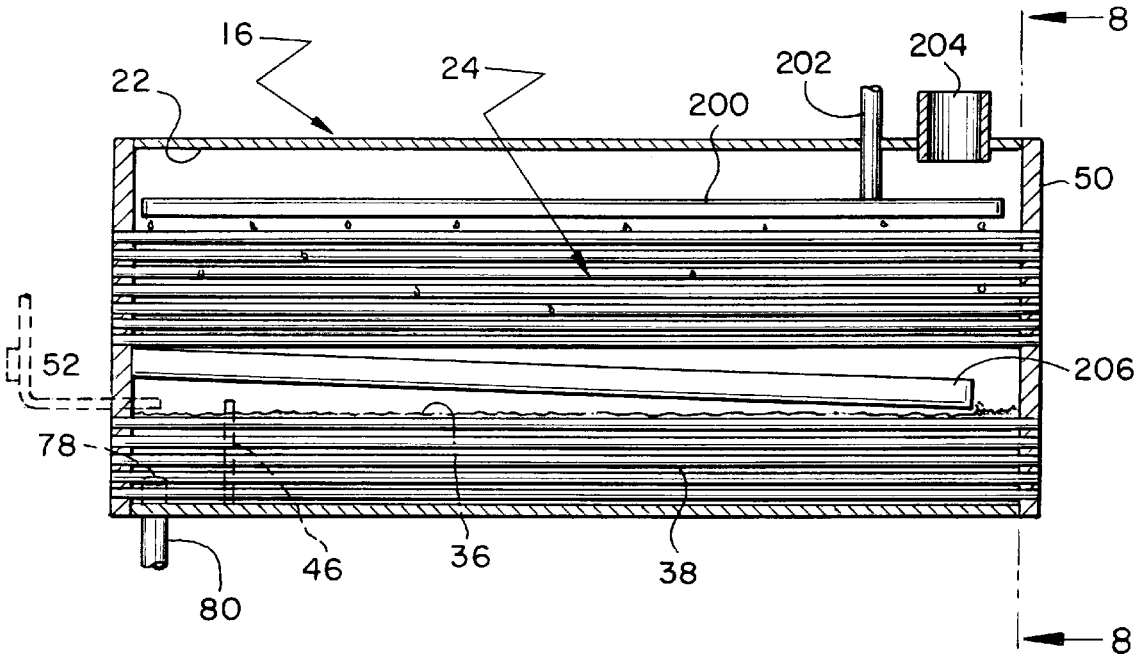
Figure 8:
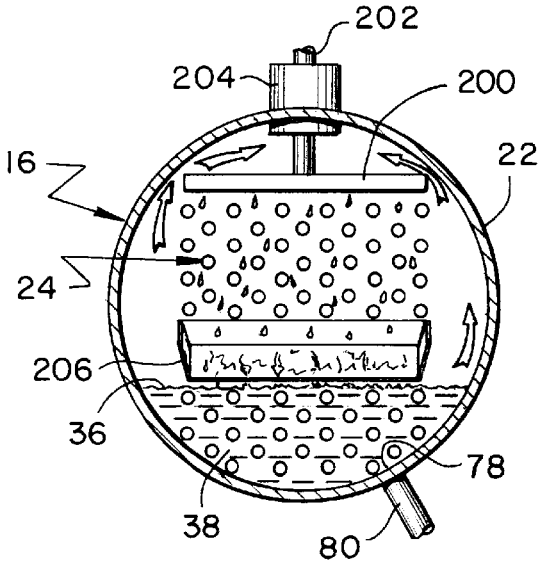

FIG. 7 and 8 are side and end views of a second embodiment of the evaporator of the present invention.

DESCRIPTION OF THE PREFERRED EMBODIMENT

Figure 1:
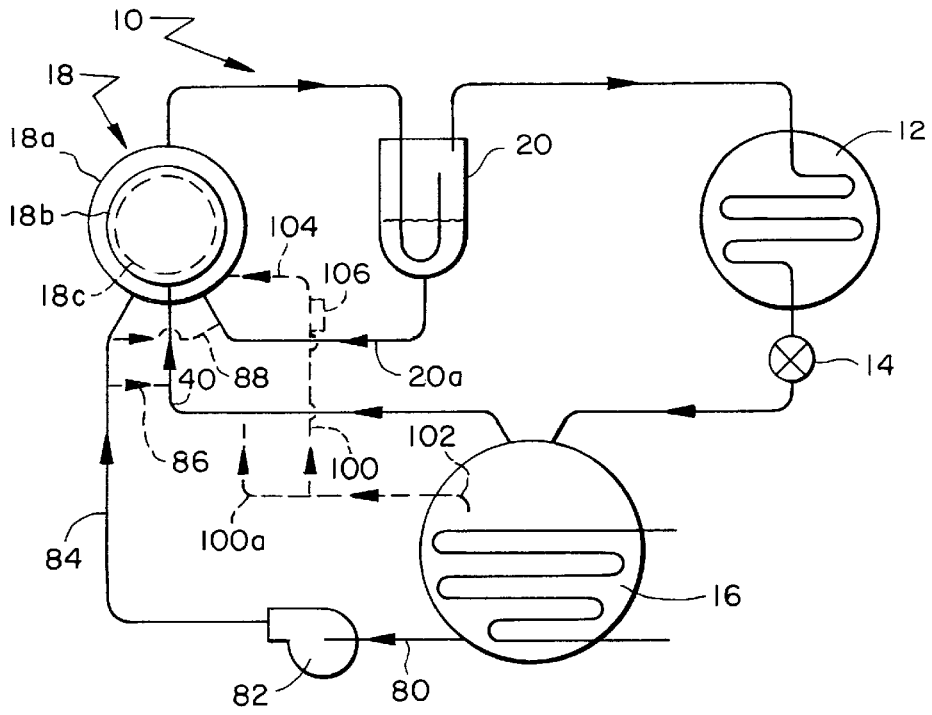
FIG. 1 is a schematic illustration of the basic components of a refrigeration chiller.

Referring initially to Drawing FIG. 1, refrigeration chiller 10 includes a condenser 12, an expansion device 14, an evaporator 16 and a motor-compressor 18. In the preferred embodiment, motor-compressor 18 includes a screw compressor 18*a* and a drive motor section 18*b* in which a motor 18*c*, shown in phantom, is disposed. Compressor 18*a* compresses the refrigerant gas it draws from evaporator 16 and discharges that gas at a higher temperature and pressure to condenser 12.

The gaseous refrigerant delivered to condenser 12 is cooled, condenses and flows thereoutof to and through expansion device 14. The flow of refrigerant through expansion device 14 causes a drop in pressure of the refrigerant. Such pressure drop causes a portion of the refrigerant to flash to gas, which, in turn, further cools the refrigerant. The refrigerant then flows, in the form of a relatively cool two-phase mixture, into evaporator 16 where, as a result of the heat exchange that occurs therein, the refrigerant is heated, vaporized and is drawn thereoutof back into compressor 18*a* of motor-compressor 18 after having been drawn through motor section 18*b* of the compressor in a manner which cools motor 18*c*.

In virtually all refrigeration chiller systems that employ a vapor compression cycle, a lubricant such as oil is used within the system compressor. In the case of chillers that employ centrifugal or scroll compressors, the purpose of the lubricant will most typically be bearing lubrication. Where the chiller is a centrifugal chiller of the gear drive type, lubricant is also used for the purpose of lubricating the gears that comprise the chiller's drive train. When a chiller is of the type which employs a screw compressor, lubricant is used for additional purposes. Among those additional purposes are to cool refrigerant gas undergoing compression within the compressor and to seal the clearance gaps between the screw rotors and their end faces and the working chamber in which the rotors are housed.

Further, in virtually all chiller systems that employ compressors, some amount of lubricant will make its way into the refrigerant gas that undergoes compression within the compressor. In screw compressor-based chillers, a relatively large amount of lubricant enters the refrigerant flow stream within the compressor and flows thereoutof. An oil separator will typically be disposed downstream of a screw compressor but upstream of the condenser in systems employing such compressors and will remove the large majority of the oil entrained in the gas stream that is discharged from the compressor. However, in the case of most chiller systems, even those which employ highly effective oil separators downstream of the system compressor, at least some of the lubricant that is carried out of the compressor will make its way into the system condenser.

Where compressor 18 is of the screw type, an oil separator 20 will be disposed downstream thereof. Separated lubricant is returned to compressor section 18*a* of compressor 18 from separator 20 via line 20*a*. The lubricant not separated by separator 20 and which makes its way into the system condenser falls to the bottom thereof where it mixes with the refrigerant that condenses therein. Liquid refrigerant and oil flows out of condenser 12, through expansion device 14, and into the system evaporator.

Figure 2:
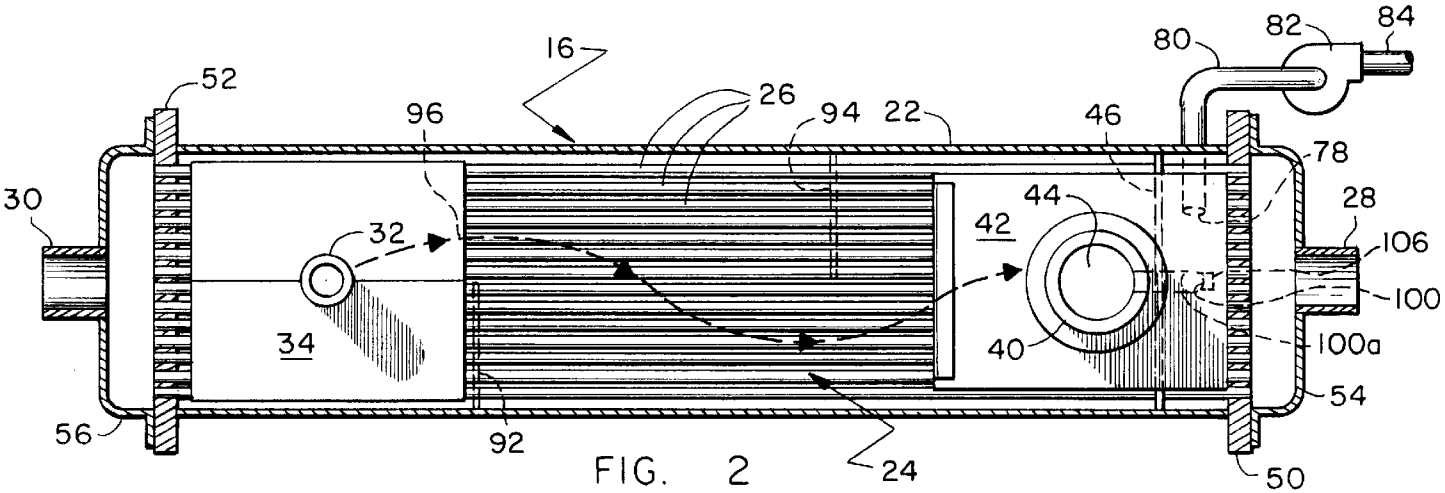
FIGS. 2 and 3 are top and side cutaway views of the evaporator of the present invention.

Referring additionally now to FIGS. 2 and 3, in the preferred embodiment of the invention, which is particularly applicable and cost effective in chillers/evaporators of generally smaller to medium capacity, evaporator 16 has a shell 22 in which horizontally running tube bundle 24 is disposed. Tube bundle 24 is comprised of a plurality of tubes 26 through which a cooling medium flows. Such cooling medium, which typically will be water, flows into evaporator 16 through an inlet 28 and flows thereoutof through an outlet 30.

It is to be noted that because inlet 28 and outlet 30 are on opposite sides of shell 22, evaporator 16 is a one, three or other odd-numbered pass evaporator meaning that the flow of the cooling medium through the tube bundle down the length of the shell occurs once, thrice or another odd number of times. Outlet 30 could, however, be disposed on the same side of shell 22 as inlet 28 in which case the cooling medium would flow a first time down the length of the evaporator, would reverse direction and would flow a second time back through a different portion of the tubes of the evaporator tube bundle. Such flow would make evaporator 16 a two-pass evaporator. Other even-numbered multiples of passes are likewise possible.

Generally speaking, the cooling medium that flows through tubes 26 of tube bundle 24 of evaporator 16 will be cooled by its rejection of the heat it carries to the refrigerant that flows into evaporator shell 22 exterior of such tubes. The cooling medium then returns, in a cooled state, from evaporator 16 to the heat load which it is the purpose of chiller 10 to cool.

In the embodiment of FIG. 2, two-phase refrigerant is delivered into shell 22 of evaporator 16 through inlet piping 32. Inlet piping 32, in turn, delivers two-phase refrigerant into liquid-vapor separator 34. In the preferred embodiment, liquid-vapor separator 34 is disposed internal of shell 22, generally at one end thereof. Liquid-vapor separator 34 could, however, be located external of shell 22.

Liquid-vapor separator 34, many designs of which are contemplated and the particular design of which is not of particular significance in terms of the evaporator of the present invention, is configured and acts generally to separate the vapor portion of the two-phase refrigerant mixture that is delivered into it from the liquid portion of that mixture. The purpose of employing separator 34 is to reduce the velocity of the liquid portion of that mixture and to cause that liquid refrigerant, together with any lubricant carried therewith, to be deposited from above, in low-velocity droplet form, generally onto one end of surface 36 of the liquid pool 38 that is found in shell 22. Separator 34 has the further purpose of preventing the carryover of liquid refrigerant, in mist form, out of the evaporator by its removal and direction of the vapor portion of the two-phase mixture into the upper region of shell 22, away from the location where the liquid portion of the mixture is deposited onto pool 38.

Apparatus other than a liquid-vapor separator to accomplish the deposit of liquid onto the surface of pool 38 are contemplated as falling within the scope of the present invention. Overall, however, use of a liquid-vapor separator is preferred for the reason that it causes the delivery from above of liquid refrigerant and any oil carried with it onto the surface of pool 38 in a manner which tends not to release a mist into the interior of the shell above the level of the liquid pool.

Separator 34 and/or the location at which the liquid portion of the two-phase mixture delivered into the separator is delivered into pool 38 is, in the FIG. 2 embodiment, generally at one end thereof. As such, the same will be true for lubricant that is carried into the evaporator with the system refrigerant. The vapor which is separated and delivered into the upper region of shell 22 by liquid-vapor separator 34, together with the vapor that is created by the heat exchange that occurs within pool 38, is drawn to the opposite end of shell 22 and into inlet 44 of compressor suction line 40, generally with little liquid content. A baffle or shield 42 may be disposed intermediate surface 36 of pool 38 and the inlet 44 to suction line 40 so as to inhibit the entry of liquid in mist and/or droplet form thereinto.

In the preferred FIG. 2 embodiment of the present invention, surface 36 of pool 38 is nominally maintained just above the top of the upper tubes in tube bundle 24 so that under typical operating conditions all or at least the majority of the tubes of the tube bundle are immersed in pool 38. An oil blockoff baffle 46 is disposed, in the FIG. 2 embodiment, within the liquid pool at the end of shell 22 opposite the end at which liquid refrigerant and any oil carried with it is deposited, from above, into the pool. The height of baffle 46 in this embodiment is such that its upper edge 48 will generally be from two to six inches above the nominal level of surface 36 of pool 38.

Disposed at the opposite ends of shell 22 are tube sheet 50 and tube sheet 52. Each is penetrated by the ends of tubes 26 of tube bundle 24. Also disposed at the ends of shell 22 are waterboxes 54 and 56. Inlet 28 to evaporator 16 connects into waterbox 54 while outlet 30 connects into waterbox 56.

The evaporator illustrated in the FIG. 2 embodiment is a three-pass evaporator. In that regard and referring additionally now to FIGS. 4 and 5, it will be appreciated that waterbox 54 has a partition 58 which restricts the cooling medium that flows into that waterbox through inlet 28 to flowing into the ends of the tubes 26 that constitute first portion 60 of tube bundle 24. The cooling medium flows through portion 60 of the tubes of tube bundle 24 and is then constrained by partition 62 of waterbox 56 at the other end of shell 22 to flow into second portion 64 of the tubes of tube bundle 24. Portion 64 of the tube bundle consists of those tubes whose ends open into waterbox 56 below partition 62 but above the tubes that constitute portion 60 of the tube bundle (see the dashed line **58*a* in FIG. 5 below which portion 60 of the tube bundle is found). This causes the cooling medium to flow back through shell 22 a second time into waterbox 54**.

Partition 58 in water box 54 then, in turn, constrains the cooling medium that flows back to waterbox 54 to reverse flow direction again and to enter third portion 66 of tube bundle 24. Portion 66 of the tubes open into waterbox 58 above both partition 58 and above dashed line **62*a* in FIG. 4. The medium then flows the length of shell 22 a third time, enters waterbox 56 and flows thereoutof through outlet 30. While the evaporator illustrated in FIG. 2** is a three-pass evaporator, the number of passes is not critical and in no way constrains or limits the scope of the present invention.

Referring additionally now to FIG. 6, oil blockoff baffle 46 defines a plurality of apertures 72 as well as a cutout 74 and/or, if advantageous in a particular application, a plurality of peripheral cutouts **76*a* and/or secondary apertures 76*b* which are illustrated in phantom. Apertures 72 are penetrated one each by individual tubes 26 of tube bundle 24 while, if employed, a plurality of tubes penetrate cutout 74. If cutouts 76*a* and/or secondary apertures 76*b* are employed, they will not be penetrated by tubes. Baffle 46 may or not support the tubes of the tube bundle. If not, apertures 72 will be of a diameter which is slightly larger than the external diameter of the individual tubes 26** which pass therethrough.

Referring to FIGS. 3 and 6 in particular and with respect to cutout 74 in baffle 46 of the preferred embodiment, cutout 74 comprises the primary entrance for oil-bearing refrigerant into portion 90 of pool 38 that exists between baffle 46 and tube sheet 50 and from which oil-rich fluid is drawn out of the pool. If secondary cutouts 76*a* are employed baffle 46, they too will permit the flow of oil into portion 90 of pool 38. Similarly, if secondary apertures 76*b* are employed they will likewise admit lubricant into portion 90 of pool 38 and may, if properly located and if in sufficient number, be employed to the exclusion of cutout 74. Some oil may also flow into portion 90 through the annular spaces that surround the tubes which penetrate apertures 72 of the baffle if those apertures are sized so as to permit such flow. If the purpose of apertures 72 is only to support the tubes of the tube bundle, they will be sized for that purpose and the flow of oil through them will generally not occur.

As will be appreciated, the flow of oil and liquid refrigerant into portion 90 of pool 38 is through baffle 46 and is sufficiently unrestricted to ensure that the level of surface 36 of pool 38 is generally the same on both sides of the baffle. This generally unrestricted flow through baffle 46 below the surface 36 of pool 38 causes lubricant to flow into portion 90 of pool 38 and prevents the unwanted concentration of oil upstream of the baffle and the associated interference of oil with the heat exchange that occurs between the relatively warm medium that flows through the tubes of the tube bundle and the portion of the liquid refrigerant in pool 38 upstream of baffle 46. It is to be noted that depending upon the particular chiller system and factors which include the desired rate of oil return and/or the then-existing system operating conditions, oil concentration in portion 90 of pool 38, downstream of baffle 46, will be relatively very high, generally on the order of from 6–15% as opposed to the 2% or less upstream of the baffle. It is also to be noted that in its preferred embodiment, baffle 46 is fabricated from an engineered material such as polypropylene.

Referring back now to FIGS. 1, 2 and 3, an outlet 78 is defined, in the preferred embodiment, in shell 22 intermediate blockoff baffle 46 and tube sheet 50 and is preferably disposed so as to communicate with the lower region of the portion of pool 38 in that location. Piping 80 runs from outlet 78 to apparatus 82, which is illustrated schematically as a pump, but could be an eductor or the like and which, when chiller 10 is in operation, motivates the flow of what will be an oil-rich mixture out of pool 38 via outlet 78. That mixture is delivered by apparatus 82 to compressor 18*a* of motor-compressor 18 via piping 84 or, alternatively, into suction line 40 via line 86 or into line 20*a* via line 88. Lines 86 and 88 are illustrated in phantom in FIG. 1.

Because of the heat exchange that occurs within pool 38 between the relatively warmer cooling medium flowing through tubes 26 and the liquid refrigerant in pool 38, liquid refrigerant will continuously vaporize along the length of tube bundle 24. That vapor bubbles to the surface 36 of pool 38 and is drawn upward, toward and into inlet 44 of suction piping 40, together with the vapor separated in liquid-vapor separator 34. Because of the continuous vaporization of liquid refrigerant within pool 38, because fluid is continuously or regularly drawn out of pool 38 through outlet 78 and because liquid refrigerant is added to the pool generally only at the end of shell 22, opposite the end where outlet 78 is located, a managed and predictable flow pattern is established within pool 38 which is generally in an axial direction away from the end of shell 22 at which liquid refrigerant and any oil flowing therewith is deposited into the pool.

With regard to the lubricant that makes its way into pool 38, the existence of lubricant in the pool adversely affects the heat transfer performance of the tubes immersed therein. This degradation is generally proportional to the concentration of the lubricant within the pool at a given location. As a result of the flow pattern that is setup within pool 38 and the continuous vaporization of liquid refrigerant thereoutof, lubricant flows from the end of pool 38 into which it was deposited toward the other end of the shell. The concentration of lubricant in pool 38 rises in a direction away from the end of pool 38 onto which liquid refrigerant and oil is initially deposited, generally from less than 1% to about 2% at the upstream side of baffle 46. Overall, however, oil concentration upstream of baffle 46 will be relatively very low, generally averaging on the order of 2% or less in all such locations, and, more typically, on the order of 1%. On the downstream side of the baffle, however, oil concentration will, under most conditions, be at least two and more often on the order of three or more times higher.

Because baffle 46 is disposed generally no more than 25% and preferably only from 10% to 15% or so of the length of shell 22 away from tube sheet 50, it will be appreciated that in the preferred embodiment about 85% to 90% of the surface area of the tubes that constitute tube bundle 24 is exposed to liquid refrigerant in which oil concentration is on the order of 1%. Because the majority of the surface area of tubes 26 of tube bundle 24 in the evaporator of the FIG. 2 embodiment is exposed to relatively very low concentrations of oil, the overall thermal performance of evaporator 16 is excellent and is, in fact, superior to the thermal performance of typical flooded evaporators that are not configured to proactively manage lubricant flow. In a general sense, the evaporator of the embodiment of FIG. 2 can be characterized as an atypical flooded evaporator in which the tube bundle is immersed in a liquid pool but in which the delivery of liquid refrigerant and any oil it contains into the interior of the evaporator shell is generally at one end thereof and is above the surface of the pool and the tube bundle therein.

Still referring to the embodiment of FIGS. 1–6, because the cooling medium that flows into evaporator 16 flows initially into first portion 60 of the tubes of tube bundle 24 and because such coolant will be at its hottest upon its initial entry into the evaporator shell, the temperature differential between the refrigerant that surrounds portion 60 of tube bundle 24 and the cooling medium that flows therethrough will be relatively high. This high temperature differential results in the relatively violent boiling of the surrounding refrigerant and creates turbulence in pool 38 around the tubes of portion 60 of the tube bundle.

After passing through the tubes that constitute portion 60 of tube bundle 24, the cooling medium flows back through the length of shell 22 through portion 64 of the tubes that constitute tube bundle 24. Because the cooling medium will have been cooled to some degree by its initial flow through portion 60 of the tube bundle 24, the liquid refrigerant that surrounds the tubes that constitute second portion 64 of the tube bundle will experience some boiling and turbulence but not to the extent that the liquid surrounding the tubes that constitute portion 60 of the tube bundle will.

On the third pass of the cooling medium down the length of shell 22, through the remaining portion 66 of the tubes of tube bundle 24, the medium will have been cooled significantly and the temperature differential between the cooling medium and the liquid refrigerant in pool 38 which surrounds that portion of the tubes will be smaller. As a result, the liquid in pool 38 in the vicinity of the tubes that third portion 66 of the tubes of the tube bundle will remain relatively calm and quiescent. Because that portion of the tube bundle is adjacent the surface 38 of pool 36, the surface of the pool will likewise be found to be relatively calm and quiescent.

Because such conditions will exist within pool 38 generally along its entire length, the turbulence created in pool 38, when a multiple pass evaporator design is employed, generally occurs in a vertical/cross-sectional sense. This localized and controlled turbulence is generally beneath the surface of the liquid pool and is beneficial in that it creates vertical eddies which prevent the stagnation or concentration of oil in specific locations within pool 38 along the length thereof. Such eddies and the creation of such turbulence, while not a necessity to the functioning of the evaporator of the present invention, is beneficial to its operation, to maintaining oil concentration low and uniform upstream of baffle 46 and, therefore, to the overall efficiency of evaporator 16.

Referring still to the FIGS. 1–6 embodiment, it is to be noted additional flow-directing baffles 92 and 94 may be employed and are illustrated in phantom in FIGS. 2 and 3. Those baffles, the use of which may enhance evaporator performance but is not necessary, result in pool 38 not only developing a flow pattern which is axial, from one end of shell 22 to the other, but which is sinusoidal in nature. In that regard, baffle 92 extends part-way across the width of shell 22 within pool 38 while baffle 94 does the same but extends from the opposite side of the shell. By the use of such baffles, liquid flow within pool 38 proceeds generally from one end of shell 22 to the other, but also, referring to arrow 96, around baffle 92 toward a first side of shell 22 then back to the other side of the shell, around baffle 94. Finally, liquid flow will reach the opposite end of the shell where blockoff baffle 46 is located. By inducing sinusoidal as opposed to direct axial flow within pool 38, the thermal efficiency of evaporator 18 can be enhanced to some degree for the reason that flow within pool 38 follows a non-linear path which prolongs the heat exchange contact of the liquid refrigerant within the pool with the tubes of the tube bundle.

Still referring to the embodiment of FIGS. 1–6, it is also to be noted that an oil-rich layer of foam 98 will generally be found to exist on the surface of portion 90 of pool 38 between baffle 46 and tube sheet 50 where oil concentration is high. Because baffle 46 extends several inches above the surface of pool 38, the existence of such foam is generally localized and limited to the surface of portion 90 of pool 38.

As an alternative to drawing refrigerant rich liquid out of pool 38 through outlet 78, by the use of piping 80 and apparatus 82, the present invention also contemplates the possibility of accomplishing oil return from portion 90 of pool 38 by the sucking of oil-rich foam off of the surface thereof. In that regard, a pipe 100 is illustrated in phantom in FIGS. 1, 2 and 3 which, in its preferred embodiment, is connected into the suction area of compressor 18*a,* downstream of motor 18*c*. Alternatively, pipe 100 can be connected into suction piping 40 as is indicated at 100*a* in FIGS. 1, 2 and 3.

The open end 102 of pipe 100 is located at a predetermined height above surface 36 of pool 38, between baffle 46 and tube sheet 50 while the discharge end 104 of line 100 preferably connects to compressor 18*a* as is indicated in FIG. 1. Where compressor 18*a* is a screw compressor, line 100 connects to the area within the compressor through which suction gas flows enroute to the screw rotors.

The height of foam layer 98 above surface 36 of pool 38 is a function of the concentration of oil in the refrigerant portion 90 of pool 38. The higher oil concentration is in portion 90 of pool 38, the greater will be the foaming effect that results from the refrigerant boiling that occurs in that portion of the pool.

By positioning open end 102 of pipe 100 at a predetermined height, the concentration of oil within portion 90 of pool 38 can generally be maintained at a predetermined level. If oil concentration comes to be low, the foam layer 98 will fall below the open end 102 of pipe 100 with the result that the withdrawal of oil from pool 38 will decrease or cease and refrigerant gas only will be drawn out of the evaporator through pipe 100. Oil concentration within portion 90 of pool 38 will, as a result, increase. As oil concentration increases, the thickness of the foam layer in portion 90 of pool 38 increases until open end 102 pipe 100 comes to be disposed within it. At that time, oil-rich foam is once again drawn out of the evaporator by the compressor and is delivered into the suction area of the compressor.

Overall, by use of the oil return arrangement described above, the concentration of oil within portion 90 of pool 38 is self-regulated in a manner which maintains it generally constant and the amount of oil which is returned to the compressor becomes a function of the overall system oil circulation rate. Further, by use of this oil return system, the need for a pump by which to return oil to the system compressor is eliminated in favor of using suction gas in the normal course of its return to the compressor. Still further, the need for proactive control and/or the use of controls in the oil return process is eliminated. Additionally, at times when an excessive amount of oil may be introduced into the evaporator, such as at chiller start-up, foaming and, therefore, the rate of oil return to the compressor increases which reduces the risk that the compressor will become starved for oil under certain start-up circumstances.

It is to be noted that an optical sensor 106 can be placed in line 100 to detect the presence of foam. Sensor 106 may be a self-heated thermistor or some other device. In this manner, oil return can be monitored for chiller protection purposes but can also facilitate the detection of a low refrigerant charge.

Next, and as has been noted, the drive since the early 1990's has been to reduce the overall refrigerant charge used in chiller systems. As such, evaporator design was driven away from flooded concepts and to falling film designs. Falling film evaporator designs have, however and as noted, brought with them certain complexities and expense not found in chiller systems that employ flooded evaporator designs. With the advent of the present invention, the issues of oil management and the adverse affect of oil on the thermal performance on evaporators that, in effect, are most similar to flooded evaporators are significantly diminished. Further, the expense of fabrication of the flowing pool evaporator of the present invention, even in the face of the cost of the additional refrigerant charge it requires, is less than that associated with most falling film designs, particularly as applied to smaller to medium-sized chillers where the size of the refrigerant charge is not so large as to offset the savings effected by the oil management achieved by the present invention.

As has previously been mentioned, the evaporator of the embodiment of FIGS. 2–6 is particularly beneficial in terms of its use in evaporators and chillers of smaller to medium capacities, where the size and cost of the chiller's refrigerant charge is not, relatively speaking, large, a second embodiment of the flowing pool evaporator of the present invention, illustrated in FIGS. 7 and 8 and which may be preferred for use in chillers of medium to larger capacities, is disclosed. Before discussing that embodiment and with respect to the particular capacity of the evaporator/chiller with which a particular embodiment of the flowing pool concept of the present invention is employed, indications are, at the time of filing of this patent application, that use of the embodiment of FIGS. 2–6 is particularly advantageous in chillers of at least up to 125 tons of refrigeration capacity.

In chillers of a capacity larger than 125 tons, current thinking is that it may be more advantageous to employ a flowing pool evaporator of the type illustrated in FIG. 7, which is yet to be described. There are, however, indications that the use of evaporators of the FIGS. 2–6 embodiment may prove to be cost-justified in refrigeration chillers of capacities up to 500 tons and, possibly, higher and work continues to better define just when the advantages of using the evaporator design of the FIGS. 1–6 embodiment which is more akin, in terms of the amount of refrigerant it requires, to a flooded evaporator, comes to be outweighed by the additional expense of the larger and more costly refrigerant charges that are required in chillers of larger capacity. Changes in the pricing of refrigerant will, as will be appreciated, affect that determination. In sum, nothing herein should be construed as limiting any one of the embodiments to use in refrigeration systems of a particular size.

Referring now to the flowing pool evaporator of FIGS. 7 and 8, it will be appreciated that this embodiment is a fairly significant departure from the embodiment of Drawing FIGS. 1–6. However, the flowing pool concept by which oil management is achieved is, as is the case in the FIGS. 1–6 embodiment, employed and is similarly integral to the operation and efficiency of the evaporator of the FIGS. 7–8 embodiment.

In the FIG. 7 embodiment, one-half or more of the tubes of tube bundle 24 reside above the surface 36 of pool 38 and preferably, in the range of 75% to 85% of the tubes of tube bundle 24 will reside above the pool surface. Because less than half of the tubes of tube bundle 24 are immersed in pool 38, because liquid refrigerant and any oil carried with it is generally uniformly distributed from above across the length and width of tube bundle 24 and because liquid refrigerant and any lubricant carried with it is deposited onto the top of the tube bundle in low energy droplet form, evaporator 16 of the FIG. 7 embodiment functions similarly to a falling film evaporator from the standpoint of liquid distribution and thermal performance.

In that regard, refrigerant distributor 200 distributes liquid refrigerant and any lubricant carried with it in a generally uniform fashion across the length and width of the tube bundle. Piping 202, which connects into distributor 200, and compressor suction piping 204, which leads out of the interior of shell 22 to the chiller's compressor, can therefore be located essentially anywhere along the axial length of the evaporator shell.

Unique within the evaporator of the FIG. 7 embodiment is the disposition of a catch pan 206 generally above surface 36 of pool 38 but below the tubes of tube bundle 24 that constitute the falling film portion of the tube bundle. In earlier falling film evaporator designs, particularly in chiller systems in which a compressor of the screw type was employed, imperfections in the uniformity of liquid distribution and/or downflow through the falling film portion of the evaporator would often result in unpredictable heat fluxes within the liquid pool 38 underlying that portion of the tube bundle and/or regions therein of high local oil concentration. Further, an oil-rich foam often existed on most or the entirety of the surface 36 of pool 38. This layer of foam tended, at times and under certain chiller operating conditions, to rise upward into the falling film portion of the tube bundle and/or to be swept upward thereinto as refrigerant boiled out of pool 38.

The entry of foam into the falling film portion of a tube bundle adversely affects the heat transfer performance of such tubes. Further, the existence of foam in that portion of a tube bundle tends to disrupt the uniform downward flow of liquid refrigerant therethrough. In the presence of such foam, the liquid refrigerant in the film flowing downward through the tube bundle tends to migrate along the foam bubbles it encounters and to be diverted away from certain of the surface Areas of at least some of the tubes. The failure of any portion of a tube surface not to be coated by or immersed in liquid refrigerant at any time is detrimental to the heat transfer efficiency of the evaporator.

Still further, in previous and current falling film evaporators, all of the adverse affects associated with oil deposition into the liquid pool at the bottom of an evaporator shell are found to exist because the lubricant delivered into the interior of a falling film evaporator is uniformly distributed, along with liquid refrigerant, across the length and width of the tube bundle. As a result, oil is deposited by design, if not purposely, across the length and width of the liquid pool which has the effect of making oil management therein and return therefrom a more difficult and less predictable process.

Even further, because refrigerant and the oil carried in it is only theoretically deposited in exact uniformity across the length and width of the tube bundle in falling film evaporators, any local maldistribution or flow disruption that occurs as the liquid refrigerant and oil flows downward through the tube bundle toward the liquid pool underlying the falling film portion of the tube bundle results in the establishment of non-uniform oil concentration within the pool. Finally, such non-uniform concentration and its location changes on an almost continuous basis.

Because distribution of liquid refrigerant and any oil it contains onto the falling film portion of a tube bundle will not be perfectly uniform and because of the complex, unmanaged flow and areas of stagnation that are set up in the liquid pools in current falling film evaporators, it can occur that the liquid in the pool at the location where oil is scavenged is relatively oil-free at a given time. When that occurs, relatively oil-free, as opposed to oil-rich liquid is drawn out of the evaporator by the oil-return apparatus/process. That, in turn, results in still higher oil concentrations in the remainder of the liquid pool and still further reduces the overall thermal performance of the evaporator.

In the FIGS. 7 and 8 embodiment of the present invention, a hybrid flowing pool-falling film evaporator is illustrated which alleviates the problems of oil foaming on the surface of pool 38 and the existence of varying oil concentrations within that pool yet which simplifies and enhances oil return from the evaporator. In that regard, refrigerant distributor 200, which can be of a single or two-phase type, deposits liquid refrigerant onto the upper surface of tube bundle 24, generally across the length and width thereof and in a generally uniform fashion. A liquid film develops within the tube bundle and flows downward therethrough by force of gravity in the traditional falling film manner. However, prior to that liquid being deposited on to surface 36 of pool 38, it is intercepted by catch pan 206 which constitutes both a physical barrier between the falling film portion of evaporator 16 and liquid pool 38 found in the lower portion thereof and apparatus for depositing liquid refrigerant and lubricant into pool 38 at a predetermined location.

Catch pan 206 underlies the falling film portion of tube bundle 24 and runs generally the length of evaporator 16, terminating close to the interior surface of one of tube sheets 50 or 52. Because catch pan 206 slopes downward and/or is open at one end, the liquid that falls into it flows to the open and/or lower end of the catch pan and is deposited from above onto surface 36 of pool 38 at one end of the evaporator shell. Gravity is therefore employed to motivate the flow of liquid within the catch pan to one end of the evaporator shell.

With the delivery of this liquid from catch pan 206 onto the surface of pool 38 from above and at one end of evaporator shell 22, pool 38 in this embodiment operates in the manner which has been described with respect to the deposit of liquid into and the flow of liquid within pool 38 in the FIGS. 2–6 embodiment. In that regard, lubricant-containing liquid is deposited out of catch pan 206 from above into pool 38 at a first end of the pool while oil outlet 78 is at the opposite end of the pool.

Once liquid refrigerant and any oil it carries is deposited onto surface 38 of pool 36 at one end of shell 22, it flows as a result of gravity, as a result of the drawing of liquid out of the pool via outlet 78 and as a result of the boiling of refrigerant out of pool 38 along its length, to the other end of the evaporator shell. This results, once again, in the concentration of oil generally at the location of lubricant outlet 78 which opens into oil return piping 80. It will be noted that catch pan 206 does not extend across the entire width of shell 22 and that a flow path exists on either side of it by which refrigerant vapor issuing from pool 38 flows, generally unobstructed and without passing back through tube bundle 24, to the upper part of the shell.

Management of oil in this embodiment is independent of whether any foaming occurs on the surface of pool 38, whether any maldistribution of liquid refrigerant and oil from refrigerant distributor 206 or occurs or whether the flow of such liquid through the tube bundle above catch pan 206 is disrupted in a particular location. Further, because of the existence of catch pan 206 and the relatively much lower number of tubes that are subject to having their heat transfer performance degraded by immersion in pool 38 in this embodiment as compared to the embodiment of FIGS. 2–6, oil blockoff baffle 46 can be dispensed with although it could be employed and is illustrated in phantom in FIG. 7 as is an oil foam return arrangement which includes pipe 100, previously described in the context of the FIGS. 1–6 embodiment. Overall, by the employment of catch pan 206 the thermal performance of the evaporator is maximized under all conditions in a manner which is simple, reliable and relatively inexpensive but also in a manner which acts to reduce the size of the refrigerant charge required by the chiller in which it is employed.

As has been noted above, because the FIG. 7 and 8 embodiment is, generally speaking, more akin to a falling film than a flooded type evaporator, it can be more expensive, primarily due to the expense associated with the fabrication and use of refrigerant distributor 206. Once again, however, in chillers of larger capacity, the expense associated with the need for a large quantity of refrigerant may make the employment of the FIG. 7 embodiment preferable. In the case of either embodiment, however, the deposit of liquid from above into the pool in the evaporator shell, at one end thereof, and the managed flow of that pool are employed and is advantageous to the evaporator in terms of thermal efficiency and oil management.

While the evaporator of the present invention has been described in terms of first and second embodiments, it will be appreciated that there are many modifications and enhancements thereto that will be apparent to those skilled in the art subsequent to being exposed to this writing. Further, while the present invention contemplates, in its preferred embodiment, the deposit of liquid refrigerant and lubricant generally onto the liquid pool at one end of the evaporator and the removal of lubricant at the other. It more broadly contemplates the deposit of liquid refrigerant and lubricant onto the pool at a first location, not necessarily at one end of the evaporator, and the recovery of lubricant at a different location, likewise not necessarily at an end of the evaporator, In each case, however, flow within the pool is managed to enhance oil-return and to enhance the thermal performance and efficiency of the evaporator. Further, while generally contemplating the deposit of liquid refrigerant and lubricant onto a tube bundle from above in its preferred embodiment, the present invention does contemplate an evaporator having a tube bundle which is at least partially immersed in a liquid pool and in which liquid refrigerant and lubricant are delivered directly into that pool. The present invention is, therefore, not limited to the described embodiments but includes modifications and enhancements thereto that will be apparent to those skilled in the art and which fall within the scope of the claims which follow.

What is claimed is:

1. A shell and tube evaporator comprising:

a shell;

a liquid pool in said shell, the liquid in said pool including liquid refrigerant and lubricant;

a horizontally running tube bundle in said shell, at least a portion of the tubes of said tube bundle being immersed in said pool for heat transfer therewith;

apparatus for depositing liquid, which includes liquid refrigerant and lubricant, into said pool at a first pool location, said apparatus for depositing liquid being disposed above the surface of said pool and depositing liquid refrigerant and lubricant into said pool from above; and a lubricant outlet, said lubricant outlet being disposed at a second pool location, said second pool location being remote from said first pool location and being a location to which lubricant in said pool flows as a result of the vaporization of refrigerant out of said pool.

2. The shell and tube evaporator according to claim 1 wherein at least the majority of the tubes of said tube bundle are immersed in said pool.

3. The evaporator according to claim 2 wherein said first pool location is generally at one end of said pool and said second pool location is generally at the end of said pool opposite said one end.

4. The evaporator according to claim 3 further comprising apparatus, disposed in said pool intermediate said first and second pool locations, for causing lubricant to concentrate proximate said second pool location.

5. The evaporator according to claim 4 wherein said lubricant outlet communicates with said pool below the surface thereof and wherein said apparatus for causing lubricant to concentrate comprises a baffle penetrated by at least the portion of the tubes of said tube bundle that are immersed in said pool.

6. The evaporator according to claim 5 wherein said apparatus for depositing liquid is a liquid-vapor separator, said liquid-vapor separator expressing vaporized refrigerant into the interior of said shell above the surface of said pool.

7. The evaporator according to claim 5 wherein said baffle extends above the surface of said pool and is penetrated by all of the tubes of said tube bundle.

8. The evaporator according to claim 5 wherein said baffle is disposed at least three-quarters of the length of the pool away from the end of said pool where said first pool location exists.

9. The evaporator according to claim 8 wherein the concentration of lubricant in said at least three-quarters of the length of said pool is less than one-half of the lubricant concentration in the remaining one-quarter thereof.

10. The evaporator according to claim 5 wherein said baffle is disposed at least 85% of the length of said pool away from the end of said pool at which said first pool location exists and wherein the average concentration of lubricant in said 85% of the length of said pool is at least three times lower than the average lubricant concentration in the remainder of said pool.

11. The evaporator according to claim 5 wherein said baffle defines a cutout penetrated by more than one of the tubes of said tube bundle, said cutout being the primary entrance for lubricant into the portion of said pool where said second pool location exists.

12. The evaporator according to claim 5 wherein said baffle defines one or more apertures which are unpenetrated by a tube of said tube bundle.

13. The evaporator according to claim 5 further comprising at least one flow-directing baffle upstream of said baffle which causes lubricant to concentrate, said at least one flow-directing baffle causing flow within said pool upstream of said lubricant concentrating baffle to follow a non-linear path in a direction towards said lubricant concentrating baffle so as to prolong the contact of liquid refrigerant within said pool with the tubes of said tube bundle.

14. The evaporator according to claim 1 wherein said lubricant outlet is above the surface of said pool.

15. The evaporator according to claim 14 wherein said first pool location is generally at one end of said pool and said second pool location is generally at the other end of said pool, said lubricant outlet being disposed at a predetermined height above said pool and generally above said second pool location.

16. The evaporator according to claim 15 wherein the tubes of said tube bundle are immersed in said pool.

17. The evaporator according to claim 16 further comprising a baffle disposed in said pool between said first and said second pool locations, said baffle being disposed closer to said second pool location than to said first pool location and being penetrated by the tubes of said tube bundle.

18. The evaporator according to claim 17 wherein said baffle defines a plurality of apertures that are unpenetrated by a tube of said tube bundle.

19. The evaporator according to claim 1 wherein at least one-half of the tubes of said tube bundle are disposed above the surface of said pool and further comprising a distributor for depositing liquid refrigerant and lubricant onto the top of the portion of said tube bundle that is disposed above the surface of said pool.

20. The evaporator according to claim 19 wherein said lubricant outlet communicates with said pool below the surface thereof and wherein said first pool location is generally at one end of said pool and said second pool location is generally at the other end of said pool.

21. The evaporator according to claim 20 wherein said apparatus for depositing liquid underlies the portion of said tube bundle which is above the surface of said pool.

22. The evaporator according to claim 21 wherein said apparatus for depositing liquid has edges along its length, said edges being spaced from the interior sides of said shell so as to permit the flow of refrigerant gas that is vaporized out of said pool upward therepast and along the external sides of the portion of said tube bundle that is disposed above the surface of said pool.

23. The evaporator according to claim 21 wherein said distributor is capable of distributing a mixture of two-phase refrigerant and lubricant into the interior of said shell.

24. The evaporator according to claim 21 further comprising apparatus for causing lubricant to concentrate at said second pool location.

25. The evaporator according to claim 24 wherein said apparatus for causing lubricant to concentrate comprises a baffle, said baffle being disposed in said pool and being interposed between said first and said second pool locations.

26. The evaporator according to claim 25 wherein said baffle is disposed generally at the end of said pool where said second pool location exists and is penetrated by the tubes of said tube bundle that are immersed in said pool.

27. The evaporator according to claim 19 wherein said lubricant outlet is above the surface of said pool.

28. A shell and tube evaporator comprising:

a shell;

a liquid pool in said shell, the liquid in said pool including liquid refrigerant and lubricant;

a lubricant outlet, said lubricant outlet being disposed at a predetermined height above the surface of said pool.

29. The evaporator according to claim 28 further comprising a tube bundle and apparatus for depositing liquid, which includes refrigerant and lubricant, onto the surface of said liquid pool from above, the tubes of said tube bundle running horizontally within said shell and at least a portion of said tubes being immersed in said pool, said apparatus for depositing liquid being disposed in said shell so as to deposit liquid into said pool at a location remote from said lubricant outlet.

30. The evaporator according to claim 29 wherein said lubricant outlet is at a location where lubricant-rich foam tends to exist on the surface of said pool.

31. The evaporator according to claim 30 wherein said location at which liquid is deposited into said pool and the location of said lubricant outlet are generally at opposite ends of said shell.

32. The evaporator according to claim 31 wherein at least a majority of the tubes of said tube bundle are immersed in said pool.

33. The evaporator according to claim 32 further comprising apparatus for causing lubricant to concentrate in the portion of said liquid pool at the end of said shell at which said lubricant outlet is located.

34. The evaporator according to claim 33 wherein said apparatus for depositing liquid into said pool from above the surface thereof comprises a liquid-vapor separator disposed internal of said shell.

35. The evaporator according to claim 33 wherein said apparatus for causing lubricant to concentrate comprises a baffle, said baffle being disposed in said pool and being penetrated by at least the portion of the tubes of said tube bundle that are immersed in said pool.

36. The apparatus according to claim 35 wherein said baffle is disposed in said pool at a location which is closer to said lubricant outlet than the location at which said apparatus for depositing liquid deposits said liquid into said pool.

37. The evaporator according to claim 31 wherein one-half or more of the tubes of said tube bundle are disposed above the surface of said pool and further comprising a distributor, said distributor overlying the portion of the tubes of said tube bundle that are above the surface of said pool, said apparatus for depositing liquid being disposed above the surface of said pool and below the portion of the tubes of said tube bundle that are above the surface of said pool.

38. The evaporator according to claim 37 wherein said apparatus for depositing liquid is a catch pan, said catch pan being disposed so as to permit the flow of refrigerant gas that is vaporized out of said pool upward along the external sides of the portion of said tube bundle that is disposed above the surface of said pool.

39. The evaporator according to claim 38 further comprising a baffle for causing lubricant to concentrate in said pool proximate said lubricant outlet.

40. A refrigeration chiller comprising:

a compressor;

a condenser;

an expansion device;

an evaporator, said evaporator having a shell, a liquid pool, apparatus for depositing liquid refrigerant and lubricant into said pool at a first pool location, a horizontally running tube bundle and a lubricant outlet, said pool being disposed in said shell and the liquid in said pool including liquid refrigerant and lubricant, said apparatus for depositing liquid being disposed above the surface of said pool in said shell and depositing liquid refrigerant and lubricant into said pool from above, said tube bundle being disposed in said shell and said lubricant outlet being disposed at a second pool location, said second pool location being remote from said first pool location and being a location to which lubricant in said pool flows as a result of the vaporization of refrigerant out of said pool; and apparatus for removing lubricant from said evaporator, said apparatus for removing lubricant communicating with said lubricant outlet of said evaporator and with said compressor.

41. The chiller according to claim 40 wherein at least the majority of the tubes of said tube bundle are immersed in said pool and wherein said first pool location is generally at one end of said pool and said second pool location is generally at other end of said pool.

42. The chiller according to claim 41 further comprising a baffle for causing lubricant to concentrate proximate said second pool location, said baffle being penetrated the portion of the tubes of said tube bundle that are immersed in said pool.

43. The chiller according to claim 42 wherein said apparatus for depositing liquid is disposed above said tube bundle and wherein said lubricant outlet communicates with said pool below the surface thereof.

44. The chiller according to claim 42 wherein said lubricant outlet communicates with the interior of said shell of said evaporator above the surface of said pool.

45. The chiller according to claim 40 wherein at least one-half of the tubes of said tube bundle are disposed above the surface of said pool and further comprising a distributor that generally overlies the length and width of the portion of said tube bundle which is above the surface of said pool, said apparatus for depositing liquid into said pool generally underlying the length and width of the portion of said tube bundle which is above the surface of said pool.

46. The chiller according to claim 45 wherein said first pool location is generally at one end of said pool, said second pool location is generally at the other end of said pool and said lubricant outlet is disposed beneath the surface of said pool proximate said second pool location.

47. The chiller according to claim 45 wherein said first pool location is generally at one end of said pool, said second pool location is generally at the other end of said pool and said lubricant outlet is disposed above the surface of said pool proximate said second pool location.

48. The liquid chiller according to claim 45 wherein said apparatus for depositing liquid comprises a catch pan, said catch pan being sloped so as to deposit liquid into said pool at said first pool location.

49. The apparatus according to claim 45 further comprising a baffle disposed in said pool between said first and said second pool locations, said baffle causing lubricant to concentrate proximate said second pool location and being penetrated by the portion of said tubes of said tube bundle that are disposed below the surface of said pool.

50. A method for returning lubricant from the shell and tube evaporator of a refrigeration chiller comprising the steps of:

maintaining a liquid pool in said evaporator in which at least a portion of the tubes of the tube bundle of said evaporator is immersed;

flowing a mixture of liquid refrigerant and lubricant into the interior of said evaporator from the expansion device of said chiller;

depositing liquid refrigerant and lubricant received into the interior of said evaporator in said flowing step onto the surface of said pool from above, generally at a first pool location;

vaporizing refrigerant out of said pool so as to induce lubricant to flow away from said first pool location to a second pool location in said pool which is remote from said first pool location; and withdrawing lubricant from said pool proximate said second pool location.

51. The method according to claim 50 comprising the further step of causing lubricant to concentrate proximate said second pool location.

52. The method according to claim 51 wherein at least the majority of the tubes of the tube bundle of said evaporator are immersed in said pool and wherein said concentrating step includes the step of disposing a baffle, which is penetrated by the portion of the tubes of said tube bundle that is immersed in said pool, intermediate said first and said second pool locations.

53. The method according to claim 52 wherein said withdrawing step includes the steps of withdrawing lubricant from said pool below the surface thereof and delivering withdrawn lubricant to the compressor of said chiller.

54. The method according to claim 52 wherein said withdrawing step includes the step of withdrawing lubricant from said pool above the surface thereof and delivering withdrawn lubricant to the compressor of said chiller.

55. The method according to claim 51 wherein the majority of the tubes of the tube bundle of said evaporator are disposed above the surface of said pool and further comprising the steps of distributing liquid, which includes refrigerant and lubricant, generally over the length and width of the top of the portion of said tube bundle that is above the surface of said pool and collecting, prior to said depositing step, liquid refrigerant and lubricant which has flowed downward through the portion of said tube bundle which is above the surface of said pool.

56. The method according to claim 55 wherein said withdrawing step includes the step of withdrawing lubricant from said pool below the surface thereof and delivering withdrawn lubricant to the compressor of said chiller.

57. The method according to claim 55 wherein said withdrawing step includes the step of withdrawing lubricant from said pool above the surface thereof and delivering withdrawn lubricant to the compressor of said chiller.

58. The method according to claim 51 wherein said withdrawing step includes the steps of withdrawing lubricant-rich foam off of the surface of said pool from a location above the surface of said pool and delivering at least the lubricant portion of said foam to said compressor.

* * * * *